US010533553B2

(12) United States Patent
Lee et al.

(10) Patent No.: US 10,533,553 B2
(45) Date of Patent: Jan. 14, 2020

(54) SINGLE-STAGE COMPRESSOR AND ENERGY SYSTEM USING THE SAME

(71) Applicant: KOREA INSTITUTE OF ENERGY RESEARCH, Daejeon (KR)

(72) Inventors: Gil Bong Lee, Seoul (KR); Young Soo Lee, Daejeon (KR); Beom Joon Lee, Daejeon (KR); Ho Sang Ra, Daejeon (KR); Young Jin Baik, Daejeon (KR); Jun Hyun Cho, Daejeon (KR); Hyung Ki Shin, Sejong-si (KR)

(73) Assignee: KOREA INSTITUTE OF ENERGY RESEARCH, Daejeon (KR)

( * ) Notice: Subject to any disclaimer, the term of this patent is extended or adjusted under 35 U.S.C. 154(b) by 102 days.

(21) Appl. No.: 15/879,931

(22) Filed: Jan. 25, 2018

(65) Prior Publication Data

US 2019/0048873 A1 Feb. 14, 2019

(30) Foreign Application Priority Data

Aug. 11, 2017 (KR) ..... 10-2017-0102276

(51) Int. Cl.
*F04C 18/16* (2006.01)
*F25B 41/04* (2006.01)
(Continued)

(52) U.S. Cl.
CPC ..... *F04C 18/16* (2013.01); *F25B 31/026* (2013.01); *F25B 41/04* (2013.01);
(Continued)

(58) Field of Classification Search
CPC ..... F04C 29/0014; F04C 18/16; F25B 1/047; F25B 31/008; F25B 41/04; F25B 2400/13;
(Continued)

(56) References Cited

U.S. PATENT DOCUMENTS 3,795,117 A * 3/1974 Moody, Jr. ..... F04C 29/042 62/197
RE30,499 E * 2/1981 Moody, Jr. ..... F04C 28/125 62/117
(Continued)

FOREIGN PATENT DOCUMENTS

KR 10-0421286 B1 3/2004

*Primary Examiner* — Frantz F Jules
*Assistant Examiner* — Lionel Nouketcha
(74) *Attorney, Agent, or Firm* — Birch, Stewart, Kolasch & Birch, LLP

(57) ABSTRACT

A single-stage compressor including one compressing unit, includes: a housing having a compressing chamber formed therein and including a suction port, which is located in one side of the compressing chamber and into which a working fluid enters, and an injection port, which is located on the compressing chamber to be spaced apart from the suction port by a predetermined distance and into which an intermediate-pressure working fluid is injected; and an intermediate-pressure valve installed on an intermediate-pressure fluid flow path on which the intermediate-pressure working fluid moves and configured to control supply of the intermediate-pressure working fluid so that the intermediate-pressure working fluid is supplied to the injection port in response to an intermediate pressure of the compressing chamber. In the injection-type compressor having a single chamber, a working fluid is injected at an intermediate pressure (not in the proximity of a suction pressure) so that efficiency and capability of the injection-type compressor having a single chamber can be improved. The injection-type compressor having a single chamber has a simple structure and is easily manufactured so that a pressure of an injection port and a corresponding intermediate pressure can be selectively set in various ways.

20 Claims, 3 Drawing Sheets

(51) Int. Cl.

| | |
|---|---|
| ***F25B 31/02*** | (2006.01) |
| *F25B 39/00* | (2006.01) |
| *F25B 1/047* | (2006.01) |
| *F25B 9/00* | (2006.01) |
| *F04C 29/00* | (2006.01) |
| *F25B 31/00* | (2006.01) |

(52) U.S. Cl.
CPC ..... *F04C 29/0014* (2013.01); *F25B 1/047* (2013.01); *F25B 9/008* (2013.01); *F25B 31/008* (2013.01); *F25B 39/00* (2013.01); *F25B 2400/13* (2013.01); *F25B 2500/07* (2013.01); *F25B 2600/2509* (2013.01); *F25B 2600/2515* (2013.01)

(58) Field of Classification Search
CPC ..... F25B 9/008; F25B 2500/07; F25B 2600/2509; F25B 2600/2517
See application file for complete search history.

(56) References Cited

U.S. PATENT DOCUMENTS

| | | | | |
|---|---|---|---|---|
| 5,640,854 | A * | 6/1997 | Fogt | F01C 1/0215 418/55.6 |
| 7,234,310 | B2 * | 6/2007 | Flynn | C09K 5/045 62/114 |
| 7,510,382 | B2 * | 3/2009 | Jeong | F04C 18/0215 418/55.1 |
| 2014/0047852 | A1 * | 2/2014 | Kim | F25B 1/06 62/79 |

* cited by examiner

SINGLE-STAGE COMPRESSOR AND ENERGY SYSTEM USING THE SAME

CROSS-REFERENCE TO RELATED PATENT APPLICATIONS

This application claims the benefit of Korean Patent Application No. 10-2017-0102276, filed on Aug. 11, 2017, in the Korean Intellectual Property Office, the disclosure of which is incorporated herein in its entirety by reference.

BACKGROUND OF THE INVENTION

1. Field of the Invention

The present invention relates to a single-stage compressor and an energy system using the same, and more particularly, to a single-stage compressor in which injection occurs in a single-stage injection-type compressor at an intermediate pressure thereof so that efficiency and capability of the single-stage compressor can be improved, and an energy system using the same.

2. Description of the Related Art

In general, a screw compressor that is used in a medium and large system so as to compress or transfer a fluid, includes a case having a flow path therein, a driving screw installed in the case and configured to be rotated by an external motor, and a driven screw configured to be rotated in combination with the driving screw. The screw compressor compresses and moves the intake fluid into the case due to rotation of the driving screw and the driven screw.

These days, a flow rate of the intake fluid is increasing, and capability of the screw compressor has been improved using an injection-type compressor that has an injection port within a casing of the compressor and enables an intermediate-pressure fluid extracted from a condenser to be supplied via the injection port.

Referring to FIG. 1 illustrating an inside of the injection-type compressor, a pair of driving screws 1 and 2 are installed in a compressing chamber 3 inside a casing 10, and a suction port 11 into which a working fluid enters from an evaporator, and an injection port 12 into which the intermediate-pressure working fluid extracted from a condenser is injected, are located in the casing 10.

However, the conventional injection-type compressor requires injection at the intermediate pressure so as to improve efficiency and capability thereof. Because the compressing chamber 3 includes a single chamber, injection occurs in the proximity of a suction pressure $P_3$, as illustrated in FIG. 2, so that efficiency of the conventional injection type compressor is decreased.

SUMMARY OF THE INVENTION

The present invention provides a single-stage compressor in which injection occurs in a single-stage injection-type compressor at an intermediate pressure so that efficiency and capability of the single-stage compressor can be improved, and an energy system using the same.

According to an aspect of the present invention, there is provided a single-stage compressor including one compressing unit, the single-stage compressor including: a housing having a compressing chamber therein and including a suction port, which is located in one side of the compressing chamber and into which a working fluid enters, and an injection port, which is located on the compressing chamber as to be spaced apart from the suction port by a predetermined distance and into which an intermediate-pressure working fluid is injected; and an intermediate-pressure valve installed on an intermediate-pressure fluid flow path on which the intermediate-pressure working fluid moves and configured to control supply of the intermediate-pressure working fluid so that the intermediate-pressure working fluid is supplied to the injection port in response to an intermediate pressure of the compressing chamber, wherein the intermediate-pressure valve includes: a valve housing having a valve space formed therein and including an inlet into which the intermediate-pressure working fluid enters, and an outlet from which the intermediate-pressure working fluid from the inlet leaves and is supplied to the injection port; and a valve body inserted into the valve space in such a way that a first space of a first pressure is formed in one side of the valve body and a second space of a second pressure corresponding to a pressure of the injection port is formed in the other side of the valve body, configured to slide due to a pressure difference between first pressure and the second pressure and including a valve flow path, which is formed in the valve body, communicates with the inlet and the outlet, respectively, and enables the intermediate-pressure working fluid from the inlet to flow into the outlet, and when the valve body is placed at a set position, the valve flow path is opened.

According to another aspect of the present invention, there is provided a single-stage compressor including one compressing unit, the single-stage compressor including: a housing having a compressing chamber therein and including a suction port, which is located in one side of the compressing chamber and into which a working fluid enters, and an injection port, which is located on the compressing chamber as to be spaced apart from the suction port by a predetermined distance and into which an intermediate-pressure working fluid is injected; and an intermediate-pressure valve installed on an intermediate-pressure fluid flow path on which the intermediate-pressure working fluid moves and configured to control supply of the intermediate-pressure working fluid so that the intermediate-pressure working fluid is supplied to the injection port in response to an intermediate pressure of the compressing chamber, wherein the intermediate-pressure valve includes: a valve housing having a valve space formed therein and including an inlet into which the intermediate-pressure working fluid enters, and an outlet from which the intermediate-pressure working fluid from the inlet leaves and is supplied to the injection port; a valve body inserted into the valve space to be able to slide in such a way that a first space is formed in one side of the valve body and a second space of a second pressure corresponding to a pressure of the injection port is formed in the other side of the valve body and including a valve flow path, which is formed in the valve body, communicates with the inlet and the outlet, respectively, and enables the intermediate-pressure working fluid from the inlet to flow into the outlet; and an elastic object placed in the first space, having one side supported at an inside surface of the valve housing and the other side elastically supporting one side of the valve body and having an elastic force corresponding to the intermediate pressure, and due to the elastic force of the elastic object and the second pressure, the valve body slides, and when the valve body is placed at a set position, the valve flow path is opened.

According to another aspect of the present invention, there is provided an energy system including: a compressor configured to compress and discharge a working fluid and having a single stage; a condenser configured to condense the working fluid discharged from the compressor; an expansion unit configured to expand and decompress the working fluid that leaves the condenser; and an evaporator configured to heat-exchange the working fluid that leaves the expansion unit with a heat-exchanging medium and to evaporate the working fluid, wherein the compressor includes: a housing having a compressing chamber therein and including a suction port, which is located in one side of the compressing chamber and into which a working fluid enters, and an injection port, which is located on the compressing chamber to be spaced apart from the suction port by a predetermined distance and into which an intermediate-pressure working fluid is injected; and an intermediate-pressure valve installed on an intermediate-pressure fluid flow path on which the intermediate-pressure working fluid moves and configured to control supply of the intermediate-pressure working fluid so that the intermediate-pressure working fluid is supplied to the injection port in response to an intermediate pressure of the compressing chamber, wherein the intermediate-pressure valve includes: a valve housing having a valve space formed therein and including an inlet into which the intermediate-pressure working fluid enters, and an outlet from which the intermediate-pressure working fluid from the inlet leaves and is supplied to the injection port; and a valve body inserted into the valve space in such a way that a first space of a first pressure is formed in one side of the valve body and a second space of a second pressure corresponding to a pressure of the injection port is formed in the other side of the valve body, configured to slide due to a pressure difference between the first pressure and the second pressure and including a valve flow path, which is formed in the valve body, communicates with the inlet and the outlet, respectively, and enables the intermediate-pressure working fluid from the inlet to flow into the outlet, and when the valve body is placed at a set position, the valve flow path is opened.

According to another aspect of the present invention, there is provided an energy system including: a compressor configured to compress and discharge a working fluid and having a single stage; a condenser configured to condense the working fluid discharged from the compressor; an expansion unit configured to expand and decompress the working fluid that leaves the condenser; and an evaporator configured to heat-exchange the working fluid that leaves the expansion unit with a heat-exchanging medium and to evaporate the working fluid, wherein the compressor includes: a housing having a compressing chamber therein and including a suction port, which is located in one side of the compressing chamber and into which a working fluid enters, and an injection port, which is located on the compressing chamber to be spaced apart from the suction port by a predetermined distance and into which an intermediate-pressure working fluid is injected; and an intermediate-pressure valve installed on an intermediate-pressure fluid flow path on which the intermediate-pressure working fluid moves and configured to control supply of the intermediate-pressure working fluid so that the intermediate-pressure working fluid is supplied to the injection port in response to an intermediate pressure of the compressing chamber, wherein the intermediate-pressure valve includes: a valve housing having a valve space formed therein and including an inlet into which the intermediate-pressure working fluid enters, and an outlet from which the intermediate-pressure working fluid from the inlet leaves and is supplied to the injection port; a valve body inserted into the valve space to be able to slide in such a way that a first space is formed in one side of the valve body and a second space of a second pressure corresponding to a pressure of the injection port is formed in the other side of the valve body and including a valve flow path, which is formed in the valve body, communicates with the inlet and the outlet, respectively, and enables the intermediate-pressure working fluid from the inlet to flow into the outlet; and an elastic object disposed in the first space, having one side supported at an inside surface of the valve housing and the other side elastically supporting one side of the valve body and having an elastic force corresponding to the intermediate pressure, and due to the elastic force of the elastic object and the second pressure, the valve body slides, and when the valve body is placed at a set position, the valve flow path is opened.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Hereinafter, exemplary embodiments of the present invention will now be described in detail with reference to the attached drawings.

Figure 1:
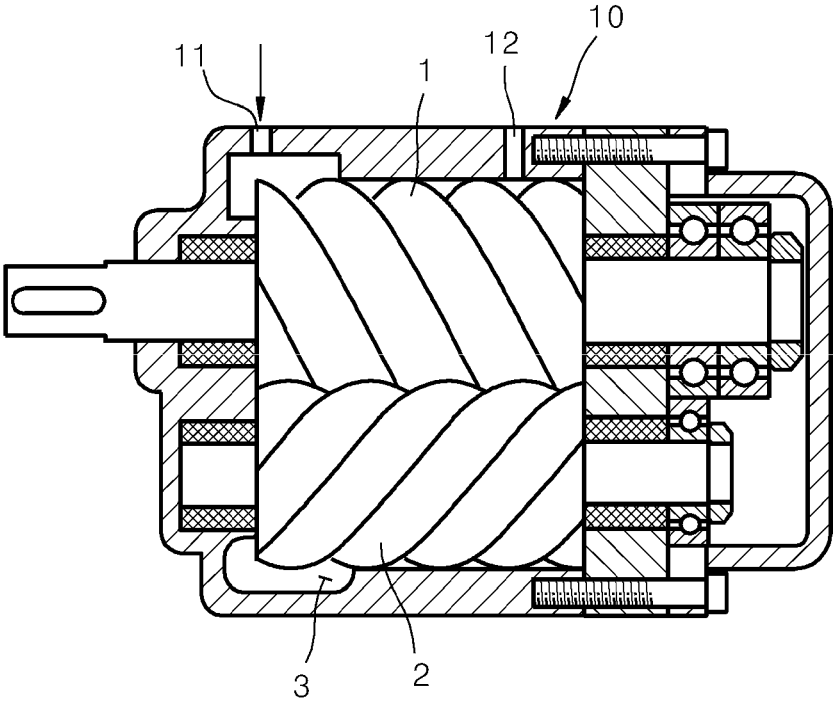
Fig. 1 Related Art
FIG. 1 is a front cross-sectional view of an internal configuration of an injection-type screw compressor according to the related art.
Figure 2:
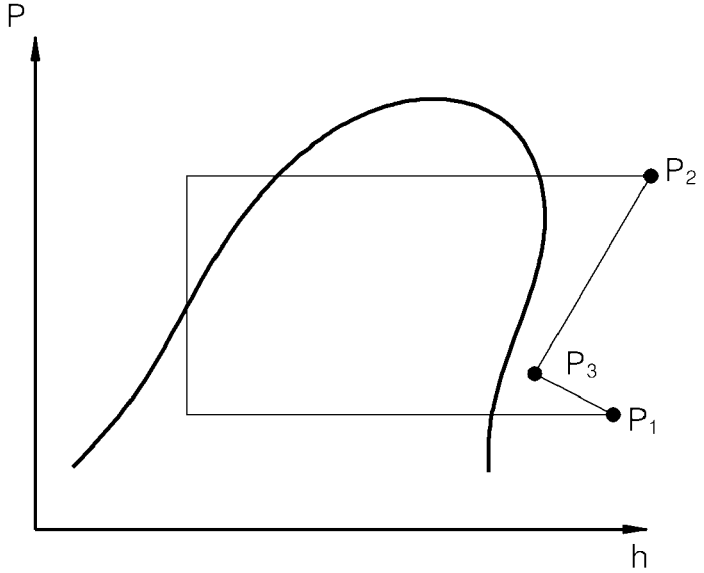
Fig. 2 Related Art
FIG. 2 is a p-h diagram of the screw compressor of FIG. 1.
Figure 3:
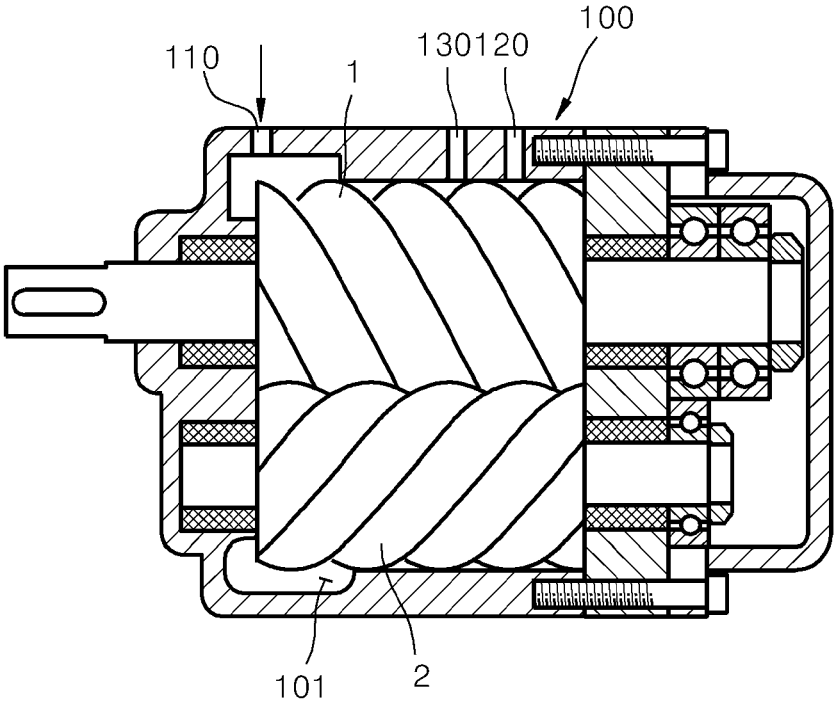
FIG. 3 is a front cross-sectional view of an internal configuration of a single-stage compressor according to an embodiment of the present invention.

First, referring to FIG. 3, a single-stage compressor including one compressing unit according to an embodiment of the present invention includes a housing 100 and an intermediate-pressure valve 200. Prior to this, in the drawings, a screw compressor is used as the single-stage compressor. However, this is just an embodiment, and of course, the invention can be applied to various compressing apparatuses, such as a scroll compressor, and the like, except for the above-described stage compressor. Hereinafter, the single-stage compressor as the screw compressor will now be described.

The housing 100 has a compressing chamber 101 formed therein, and a pair of rotating screw rotors 1 and 2 are located in the compressing chamber 101. A suction port 110 into which a working fluid enters, is placed at one side of an upper portion of the housing 100, and a discharge port (not shown) from which the compressed working fluid leaves, is formed through the housing 100.

The housing 100 has the compressing chamber 101 to be spaced apart from the suction port 110 by a predetermined distance and has an injection port 120 into which the working fluid having an intermediate pressure is injected. The injection port 120 communicates with an intermediate-pressure fluid flow path on which the intermediate-pressure working fluid passing through a condenser in a refrigerating cycle flows, and the intermediate-pressure working fluid is supplied into the injection port 120.

The intermediate-pressure valve 200 is installed on the intermediate-pressure fluid flow path on which the intermediate-pressure working fluid flows, and controls the supply of the intermediate-pressure working fluid so that the intermediate-pressure working fluid can be supplied to the injection port 120 in response to an intermediate pressure (see $P_3'$ of FIG. 4) of the compressing chamber 101.

Figure 4:
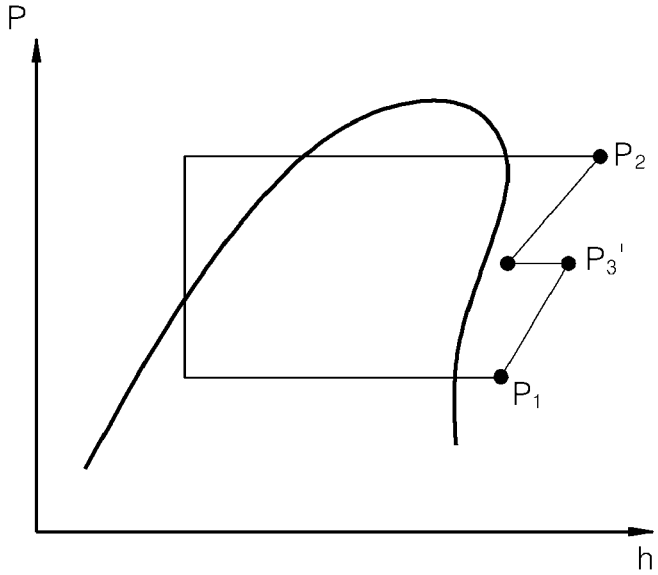
FIG. 4 is a p-h diagram of the single-stage compressor of FIG. 3.

That is, as illustrated in FIG. 4, the intermediate-pressure valve 200 enables the intermediate-pressure working fluid to be supplied to the injection port 120 in response to a valve opening timing at which an intermediate pressure is formed, unlike in a screw compressor according to the related art in which an intermediate-pressure working fluid is injected in the proximity of a suction pressure.

Figure 5:
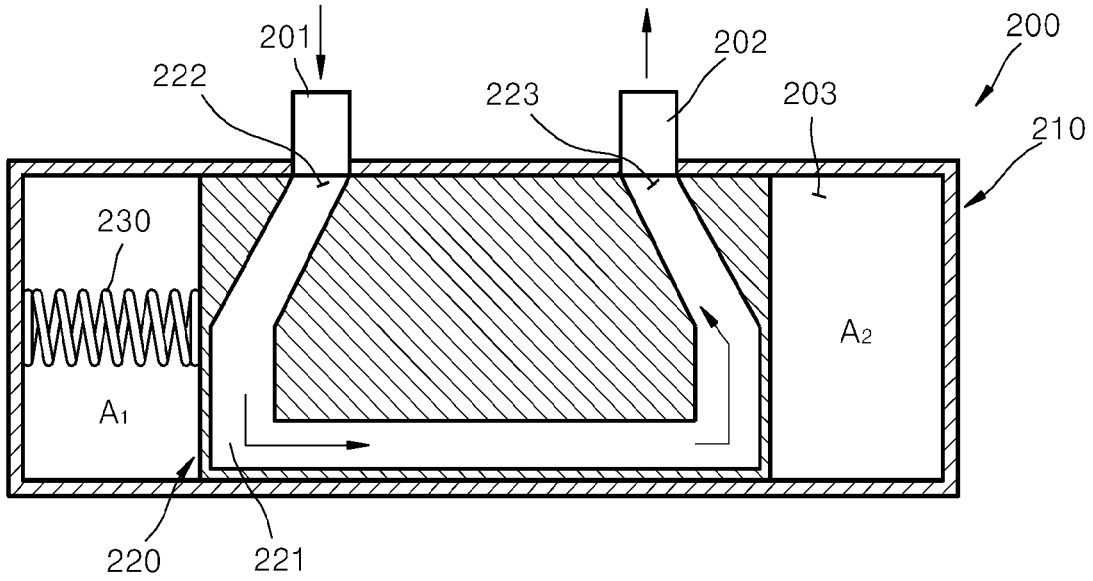
FIG. 5 is a front cross-sectional view of a configuration of an intermediate-pressure valve of the single-stage compressor of FIG. 3.

Referring to FIG. 5, the intermediate-pressure valve 200 includes a valve housing 210 and a valve body 220. The valve housing 210 has a valve space formed therein and includes an inlet 201, which is formed at one side of an upper portion of the valve housing 210 and into which the intermediate-pressure working fluid enters, and an outlet 202, which is formed at the other side of the upper portion of the valve housing 210 and from which the intermediate-pressure working fluid from the inlet 201 leaves and is supplied to the injection port 120.

The valve body 220 is inserted into the valve space and has a smaller size than that of the valve space so as to slide within the valve space. The valve body 220 is inserted into the valve space in such a way that top and bottom surfaces of the valve body 220 are adjacent to an inside surface of the valve housing 210, a first space A1 is formed within the valve space in a left direction and a second space A2 is formed within the valve space in a right direction.

The valve body 220 includes a valve flow path 221, which is formed in the valve body 220, communicates with the inlet 201 and the outlet 202, respectively, and enables the intermediate-pressure working fluid from the inlet 201 to flow into the outlet 202, and when the valve body 220 is placed at a set position, the valve flow path 221 is opened.

The valve body 220 is inserted into the valve space, has an entrance 222 into which the intermediate-pressure working fluid enters in a direction toward a top surface corresponding to the inlet 201 and the outlet 202, and an exit 223 from which the intermediate-pressure working fluid leaves, respectively, and has the valve flow path 221 having an U-shape formed in the valve body 220.

In the drawings, the valve flow path 221 includes a first flow path that communicates with the inlet 201, a third flow path that communicates with the outlet 202, and a second flow path that enables the first flow path and the third flow path to communicate with each other.

The first flow path is inclined in a downward direction from the entrance 222 formed at an upper portion of the valve body 220 so that the intermediate-pressure working fluid flowing through the inlet 201 and the entrance 222 moves to be inclined in the downward direction.

The second flow path communicates with the first flow path and is formed horizontally with respect to a lower portion of the valve body 220.

The third flow path communicates with the second flow path, communicates with the exit 223, enables the intermediate-pressure working fluid that leaves the third flow path to be injected into the outlet 202, is inclined in an upward direction.

In the drawings, the valve flow path 221 includes the downwardly-inclined first flow path, the horizontal, second flow path, and the upwardly-inclined third flow path, as described above. However, this is an embodiment, and all types of the valve flow path 221 having a configuration in which the above-described inlet 201 and outlet 202 can be opened/closed according to sliding movement of the valve body 220, can be used.

Figure 6:
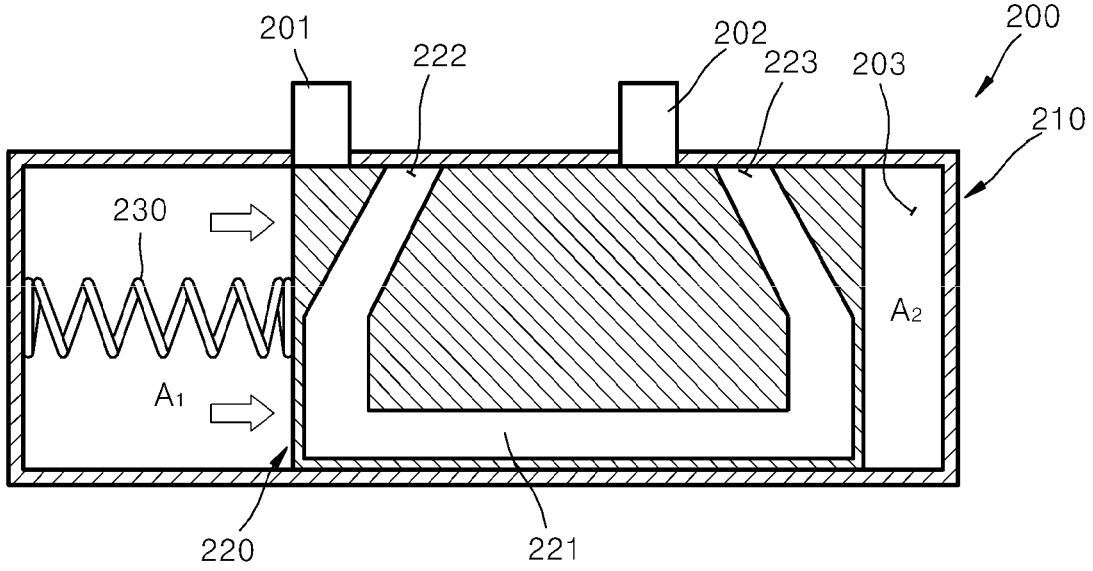
FIG. 6 is a front cross-sectional view showing the case where an opened intermediate-pressure valve of FIG. 5 slides and a valve path is closed.

The above-described valve body 220 slides in a left/right direction due to a pressure difference between a pressure of the first space A1 and a pressure of the second space A2, and as illustrated in FIG. 6, the inlet 201 and the entrance 222, and the outlet 202 and the exit 223 are offset against each other according to sliding movement so that the supply of the intermediate-pressure working fluid is cut off.

Hereinafter, an atmosphere or conditions of the first space A1 and the second space A2 for sliding the valve body 220 will now be described.

First, the first space A1 has an atmosphere of a first pressure corresponding to the intermediate pressure, and the second space A2 has an atmosphere of a second pressure corresponding to a pressure of the injection port 120. Thus, the valve body 220 slides due to a difference between the intermediate pressure that is the first pressure of the first space A1 and the pressure of the injection port 120 that is the second pressure of the second space A2.

In this case, when the difference between the intermediate pressure and the pressure of the injection port 120 is within a setting range, for example, when the pressure of the injection port 120 is equal to or higher than the intermediate pressure by a setting value, the valve body 220 is moved to a position in which the inlet 201 and the entrance 222 and the outlet 202 and the exit 223 are aligned with respect to each other. In this case, the valve flow path 221 is opened, and the intermediate-pressure working fluid is supplied to the injection port 120.

The first space A1 communicates with an intermediate-pressure port 130 formed in the housing 100 so as to have an intermediate pressure at the intermediate-pressure port 130. Here, the intermediate-pressure port 130 is formed through the housing 100 at a position in which a pressure of the compressing chamber 101 is a target intermediate pressure.

Thus, the first space A1 communicates with the intermediate-pressure port 130 so that the first pressure corresponds to the pressure of the intermediate-pressure port 130, and the valve body 220 slides due to a difference between the pressure of the intermediate-pressure port 130 and the pressure of the injection port 120.

In this case, when a difference between the pressure of the intermediate-pressure port 130 and the pressure of the injection port 120 is within a setting range, for example, when the pressure of the injection port 120 is equal to or higher than the pressure of the suction port 110 by a setting value, the valve body 220 is disposed at a position in which the inlet 222 and the exit 223 are aligned with respect to each other, and the intermediate-pressure working fluid is supplied at the pressure of the injection port 120.

In another embodiment, the first pressure may be formed in the first space A1 to correspond to a suction pressure of the working fluid supplied to the housing 100, and the second space A2 may be formed to have an atmosphere of the second pressure corresponding to the pressure of the injection port 120. Thus, the first space A1 communicates with the suction port 110 or an intake flow path and thus is at a suction pressure atmosphere, and the second space A2 communicates with the injection port 120 and is at an atmosphere of the pressure of the injection port 120.

Thus, the valve body 220 slides due to the suction pressure of the working fluid and the pressure of the injection port 120, and when a difference between the suction pressure and the pressure of the injection port 120 is within a setting range, the valve body 220 is placed at a set position, and the intermediate-pressure working fluid is supplied at the pressure of the injection port 120.

As described above, an elastic object 230 having a particular spring constant corresponding to the intermediate pressure can be installed in the first space A1 and thus, the valve body 220 can slide, unlike in the embodiment in which the first space A1 communicates with the suction port 110 and the intermediate-pressure port 130, respectively, and the first pressure is formed as a pressure corresponding to the suction pressure and the intermediate pressure and thus the valve body 220 slides, as described above.

This will now be described with reference to FIG. 5. The elastic object 230 having a spring constant due to design is installed in the first space A1, and the elastic object 230 supports one side of the valve body 220. Also, the second space A2 has an atmosphere of the second pressure corresponding to the pressure of the injection port 120.

In detail, the elastic object 230 is disposed in the first space A1 of the valve housing 210, has one side supported at the inside surface of the valve housing 210 and the other side elastically supporting one side of the valve body 220, and has an elastic force corresponding to the intermediate pressure.

Thus, the valve body 220 slides due to the elastic force of the elastic object 230 and the pressure of the injection port 120 to open/close the valve flow path 221, as illustrated in FIG. 6.

The intermediate-pressure valve 200 is installed on the intermediate-pressure fluid flow path, as described above, to cut off the supply of the intermediate-pressure fluid supplied to the injection port 120 or to supply the intermediate-pressure fluid. Alternatively, the intermediate-pressure valve 200 may also be coupled to the housing 100 on the periphery of the injection port 120.

As described above, in the single-stage compressor according to embodiments of the present invention, the intermediate-pressure working fluid is injected at the intermediate pressure (not in the proximity of the suction pressure) so that efficiency and capability of the single-stage compressor can be improved, and the above-described single-stage compressor can be used in various energy systems.

The energy system includes a compressor, a condenser that condenses the working fluid discharged from the compressor, an expansion unit that expands the working fluid passing through the condenser and decompresses the working fluid, and an evaporator that heat-exchanges the working fluid leaving the expansion unit with a heat-exchanging medium and evaporates the working fluid. The above-described elements are sequentially arranged in the energy system. Thus, the energy system can be used in various energy systems, such as a heat pump system or an air-conditioning system.

Here, the compressor is the above-described single-stage compressor, and the working fluid that leaves the evaporator enters and is compressed, and the intermediate-pressure fluid that leaves the condenser is injected, and the intermediate-pressure valve is installed on the intermediate-pressure fluid flow path on which the intermediate-pressure fluid flows.

As described above, a single-stage compressor according to an embodiment of the present invention and an energy system using the same have the following effects.

Firstly, in a single-stage injection-type compressor, an intermediate-pressure working fluid is injected at an intermediate pressure (not in the proximity of a suction pressure) so that efficiency and capability of the single stage compressor can be improved.

Secondly, the single-stage compressor has a simple structure and is easily manufactured so that a pressure of an injection port and a corresponding intermediate pressure can be selectively set in various ways and thus various designs can be provided.

Thirdly, the single-stage compressor can be easily used in an existing single-stage compressor and can be used in a screw compressor, a scroll compressor, and a rotary compressor, and the like, in various manners.

Fourthly, an energy system can be configured using the single-stage compressor, and this energy system can be widely utilized in a heat pump system or an air-conditioning system.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A single-stage compressor comprising:

a housing having a compressing chamber formed therein and comprising a suction port, which is located in one side of the compressing chamber and into which a working fluid enters, and an injection port, which is located on the compressing chamber to be spaced apart from the suction port by a predetermined distance and into which an intermediate-pressure working fluid is injected;

an intermediate-pressure valve installed on an intermediate-pressure fluid flow path on which the intermediate-pressure working fluid moves, wherein the intermediate-pressure valve is configured to control supply of the intermediate-pressure working fluid so that the intermediate-pressure working fluid is supplied to the injection port in response to an intermediate pressure of the compressing chamber; and an intermediate-pressure port formed through the housing at a position in which a pressure of the compressing chamber is the intermediate pressure, wherein the intermediate-pressure valve comprises:

a valve housing having a valve space formed therein and comprising an inlet into which the intermediate-pressure working fluid enters, and an outlet from which the intermediate-pressure working fluid from the inlet leaves and is supplied to the injection port; and a valve body inserted into the valve space in such a way that a first space of a first pressure is formed in one side of the valve body and a second space of a second pressure corresponding to a pressure of the injection port is formed in the other side of the valve body, wherein the valve body is configured to slide due to a pressure difference between the first pressure and the second pressure and comprising a valve flow path, which is formed in the valve body, wherein the valve flow path communicates with the inlet and the outlet, respectively, and enables the intermediate-pressure working fluid introduced from the inlet to flow into the outlet, and when the valve body is placed at a set position, the valve flow path is opened.

2. The single-stage compressor of claim 1, wherein the first space communicates with the intermediate-pressure port so that the first pressure corresponds to a pressure of the intermediate-pressure port, and the valve body slides due to the pressure of the intermediate-pressure port and the pressure of the injection port.

3. The single-stage compressor of claim 2, wherein, when a difference between the pressure of the intermediate-pressure port and the pressure of the injection port is within a setting range, the valve body is placed at the set position so that the intermediate-pressure working fluid is supplied at the pressure of the injection port.

4. The single-stage compressor of claim 1, wherein the first pressure is formed in the first space to correspond to a suction pressure of the working fluid supplied to the housing, and the valve body slides due to the suction pressure of the working fluid and the pressure of the injection port.

5. The single-stage compressor of claim 4, wherein, when a difference between the suction pressure of the working fluid and the pressure of the injection port is within a setting range, the valve body is placed at the set position so that the intermediate-pressure working fluid is supplied at the pressure of the injection port.

6. The single-stage compressor of claim 1, wherein the valve housing comprises the inlet and the outlet, which are formed at an upper side of the valve housing and are spaced apart from each other by a predetermined distance, and the valve body is inserted into the valve space, has an entrance into which the intermediate-pressure working fluid enters in a direction toward a top surface corresponding to the inlet and the outlet, and an exit from which the introduced intermediate-pressure working fluid is discharged, respectively, and has the U-shaped valve flow path formed in the valve body.

7. The single-stage compressor of claim 6, wherein the valve flow path comprises a first flow path inclined in a downward direction so that the intermediate-pressure working fluid introduced from the entrance formed at an upper portion of the valve body moves to be inclined in the downward direction, a second flow path that communicates with the first flow path and is formed horizontally with respect to a lower portion of the valve body, and a third flow path inclined in an upward direction so as to communicate with the second flow path and to communicate with the exit.

8. A single-stage compressor comprising:

a housing having a compressing chamber formed therein and comprising a suction port, which is located in one side of the compressing chamber and into which a working fluid enters, and an injection port, which is located on the compressing chamber to be spaced apart from the suction port by a predetermined distance and into which an intermediate-pressure working fluid is injected;

an intermediate-pressure valve installed on an intermediate-pressure fluid flow path on which the intermediate-pressure working fluid moves, wherein the intermediate-pressure valve is configured to control supply of the intermediate-pressure working fluid so that the intermediate-pressure working fluid is supplied to the injection port in response to an intermediate pressure of the compressing chamber; and an intermediate-pressure port formed through the housing at a position in which a pressure of the compressing chamber is the intermediate pressure, wherein the intermediate-pressure valve comprises:

a valve housing having a valve space formed therein and comprising an inlet into which the intermediate-pressure working fluid enters, and an outlet from which the intermediate-pressure working fluid from the inlet leaves and is supplied to the injection port;

a valve body inserted into the valve space to be able to slide in such a way that a first space is formed in one side of the valve body and a second space of a second pressure corresponding to a pressure of the injection port is formed in the other side of the valve body and comprising a valve flow path, which is formed in the valve body, communicates with the inlet and the outlet, respectively, and enables the intermediate-pressure working fluid from the inlet to flow into the outlet; and a spring disposed in the first space, having one side supported at an inside surface of the valve housing and the other side elastically supporting one side of the valve body and having an elastic force corresponding to the intermediate pressure, and due to the elastic force of the spring and the second pressure, the valve body slides, and when the valve body is placed at a set position, the valve flow path is opened.

9. The single-stage compressor of claim 8, wherein the valve housing comprises the inlet and the outlet, which are formed at an upper side of the valve housing and are spaced apart from each other by a predetermined distance, and the valve body is inserted into the valve space, has an entrance into which the intermediate-pressure working fluid enters in a direction toward a top surface corresponding to the inlet and the outlet, and an exit from which the introduced intermediate-pressure working fluid is discharged, respectively, and has the U-shaped valve flow path formed in the valve body.

10. The single-stage compressor of claim 9, wherein the valve flow path comprises a first flow path inclined in a downward direction so that the intermediate-pressure working fluid introduced from the entrance formed at an upper portion of the valve body moves to be inclined in the downward direction, a second flow path that communicates with the first flow path and is formed horizontally with respect to a lower portion of the valve body, and a third flow path inclined in an upward direction so as to communicate with the second flow path and to communicate with the exit.

11. An energy system comprising:

a compressor configured to compress and discharge a working fluid and having a single stage;

a condenser configured to condense the working fluid discharged from the compressor;

an expansion valve configured to expand and decompress the working fluid that leaves the condenser; and an evaporator configured to heat-exchange the working fluid that leaves the expansion valve with a heat-exchanging medium and to evaporate the working fluid, wherein the compressor comprises:

a housing having a compressing chamber formed therein and comprising a suction port, which is located in one side of the compressing chamber and into which a working fluid enters, and an injection port, which is located on the compressing chamber to be spaced apart from the suction port by a predetermined distance and into which an intermediate-pressure working fluid is injected;

an intermediate-pressure valve installed on an intermediate-pressure fluid flow path on which the intermediate-pressure working fluid moves, wherein the intermediate-valve is configured to control supply of the intermediate-pressure working fluid so that the intermediate-pressure working fluid is supplied to the injection port in response to an intermediate pressure of the compressing chamber; and an intermediate-pressure port formed through the housing at a position in which a pressure of the compressing chamber is the intermediate pressure, wherein the intermediate-pressure valve comprises:

a valve housing having a valve space formed therein and comprising an inlet into which the intermediate-pressure working fluid enters, and an outlet from which the intermediate-pressure working fluid from the inlet leaves and is supplied to the injection port; and a valve body inserted into the valve space in such a way that a first space of a first pressure is formed in one side of the valve body and a second space of a second pressure corresponding to a pressure of the injection port is formed in the other side of the valve body, wherein the valve body is configured to slide due to a pressure difference between the first pressure and the second pressure and comprising a valve flow path, which is formed in the valve body, wherein the valve flow path communicates with the inlet and the outlet, respectively, and enables the intermediate-pressure working fluid introduced from the inlet to flow into the outlet, and when the valve body is placed at a set position, the valve flow path is opened.

12. The energy system of claim 11, wherein the first space communicates with the intermediate-pressure port so that the first pressure corresponds to a pressure of the intermediate-pressure port, and the valve body slides due to the pressure of the intermediate-pressure port and the pressure of the injection port.

13. The energy system of claim 12, wherein, when a difference between the pressure of the intermediate-pressure port and the pressure of the injection port is within setting range, the valve body is placed at the set position so that the intermediate-pressure working fluid is supplied at the pressure of the injection port.

14. The energy system of claim 11, wherein the first pressure is formed in the first space to correspond to a suction pressure of the working fluid supplied to the housing, and the valve body slides due to the suction pressure of the working fluid and the pressure of the injection port.

15. The energy system of claim 14, wherein, when a difference between the suction pressure of the working fluid and the pressure of the injection port is within a setting range, the valve body is placed at the set position so that the intermediate-pressure working fluid is supplied at the pressure of the injection port.

16. The energy system of claim 11, wherein the valve housing comprises the inlet and the outlet, which are formed at an upper side of the valve housing and are spaced apart from each other by a predetermined distance, and the valve body is inserted into the valve space, has an entrance into which the intermediate-pressure working fluid enters in a direction toward a top surface corresponding to the inlet and the outlet, and an exit from which the introduced intermediate-pressure working fluid is discharged, respectively, and has the U-shaped valve flow path formed in the valve body.

17. The energy system of claim 16, wherein the valve flow path comprises a first flow path inclined in a downward direction so that the intermediate-pressure working fluid introduced from the entrance formed at an upper portion of the valve body moves to be inclined in the downward direction, a second flow path that communicates with the first flow path and is formed horizontally with respect to a lower portion of the valve body, and a third flow path inclined in an upward direction so as to communicate with the second flow path and to communicate with the exit.

18. The energy system of claim 16, wherein the energy system comprises a heat pump system or a refrigerating machine.

19. An energy system comprising:

a compressor configured to compress and discharge a working fluid and having a single stage;

a condenser configured to condense the working fluid discharged from the compressor;

an expansion valve configured to expand and decompress the working fluid that leaves the condenser; and an evaporator configured to heat-exchange the working fluid that leaves the expansion valve with a heat-exchanging medium and to evaporate the working fluid, wherein the compressor comprises:

a housing having a compressing chamber formed therein and comprising a suction port, which is located in one side of the compressing chamber and into which a working fluid enters, and an injection port, which is located on the compressing chamber to be spaced apart from the suction port by a predetermined distance and into which an intermediate-pressure working fluid is injected; and an intermediate-pressure valve installed on an intermediate-pressure fluid flow path on which the intermediate-pressure working fluid moves, wherein the intermediate-pressure valve is configured to control supply of the intermediate-pressure working fluid so that the intermediate-pressure working fluid is supplied to the injection port in response to an intermediate pressure of the compressing chamber; and an intermediate-pressure port formed through the housing at a position in which a pressure of the compressing chamber is the intermediate pressure, wherein the intermediate-pressure valve comprises:

a valve housing having a valve space formed therein and comprising an inlet into which the intermediate-pressure working fluid enters, and an outlet from which the intermediate-pressure working fluid from the inlet leaves and is supplied to the injection port;

a valve body inserted into the valve space to be able to slide in such a way that a first space is formed in one side of the valve body and a second space at an atmosphere of a second pressure corresponding to a pressure of the injection port is formed in the other side of the valve body and comprising a valve flow path, which is formed in the valve body, wherein the valve flow path communicates with the inlet and the outlet, respectively, and enables the intermediate-pressure working fluid from the inlet to flow into the outlet; and a spring disposed in the first space, having one side supported at an inside surface of the valve housing and the other side elastically supporting one side of the valve body and having an elastic force corresponding to the intermediate pressure, and due to the elastic force of the spring and the second pressure, the valve body slides, and when the valve body is placed at a set position, the valve flow path is opened.

20. The energy system of claim 19, wherein the valve housing comprises the inlet and the outlet, which are formed at an upper side of the valve housing and are spaced apart from each other by a predetermined distance, and the valve body is inserted into the valve space, has an entrance into which the intermediate-pressure working fluid enters in a direction toward a top surface corresponding to the inlet and the outlet, and an exit from which the intermediate-pressure working fluid leaves, respectively, and has the U-shaped valve flow path formed in the valve body, and the valve flow path comprises a first flow path inclined in a downward direction so that the intermediate-pressure working fluid introduced from the entrance formed at an upper portion of the valve body moves to be inclined in the downward direction, a second flow path that communicates with the first flow path and is formed horizontally with respect to a lower portion of the valve body, and a third flow path inclined in an upward direction so as to communicate with the second flow path and to communicate with the exit.

* * * * *